US005161938A

United States Patent [19]

Traegaardh

[11] Patent Number: 5,161,938

[45] Date of Patent: Nov. 10, 1992

[54] AUTOMATIC SUPPLY AND LOADING DEVICE FOR SHEET ITEMS

[75] Inventor: Paul Traegaardh, Tokyo, Japan

[73] Assignee: AB Tetra Pak, Lund, Sweden

[21] Appl. No.: 689,724

[22] Filed: Apr. 22, 1991

Related U.S. Application Data

[63] Continuation of Ser. No. 401,987, Sep. 1, 1989, abandoned.

[30] Foreign Application Priority Data

Sep. 2, 1988 [JP] Japan ..... 63-220670

[51] Int. Cl.[5] ..... B65H 1/26; B65H 1/30

[52] U.S. Cl. ..... 414/795.8; 198/468.2; 221/11; 221/174; 271/9; 271/157; 414/416; 414/728; 414/751; 901/1

[58] Field of Search ..... 221/11, 174, 10, 92, 221/104, 105, 106; 414/268, 277, 416, 417, 728, 795.8, 279, 281, 283, 757, 790.2, 799, 792.9, 789.6; 271/9, 157; 901/1, 6; 198/468.2, 468.9

[56] References Cited

U.S. PATENT DOCUMENTS

| | | | |
|---|---|---|---|
| 3,504,808 | 4/1970 | Carabateas | 414/283 |
| 3,528,576 | 9/1970 | Runyan et al. | 414/417 |
| 3,907,273 | 9/1975 | Runyan et al. | 414/795.8 X |
| 4,526,501 | 7/1985 | Blumle | 414/795.8 X |
| 4,538,511 | 9/1985 | Wise | 414/790.2 X |
| 4,618,054 | 10/1986 | Muller | 414/790.2 X |
| 4,662,624 | 5/1987 | Focke | 414/795.8 X |
| 4,696,615 | 9/1987 | Ettischer et al. | 414/416 X |
| 4,750,132 | 6/1988 | Pessina et al. | 414/751 X |
| 4,854,815 | 8/1989 | Augst | 414/795.8 X |
| 4,907,941 | 3/1990 | Focke et al. | 414/795.8 |

FOREIGN PATENT DOCUMENTS

| | | | |
|---|---|---|---|
| 2231743 | 4/1973 | Fed. Rep. of Germany | 414/790.2 |
| 3017612 | 11/1981 | Fed. Rep. of Germany | 414/792.9 |
| 562464 | 9/1977 | U.S.S.R. | 414/279 |

*Primary Examiner*—David A. Bucci
*Assistant Examiner*—Janice Krizek
*Attorney, Agent, or Firm*—Koda and Androlia

[57] ABSTRACT

An automatic supply and loading device for container blanks such as gable top containers including storage magazines for storing therein the blanks in a flat collapsed form at a location away from the main magazines from which the blanks are individually transferred to later processes in a liquid food charging machine. A robot with a pair of grasping claws is provided between the main magazines and the storage magazines so that the robot carries the blanks between the magazines and loads and unloads the blanks in and from the magazines. The main magazines can be inclined at the same angle as the angle of inclination of the robot for securing smooth loading and unloading of the blanks.

2 Claims, 4 Drawing Sheets

AUTOMATIC SUPPLY AND LOADING DEVICE FOR SHEET ITEMS

This is a continuation of application Ser. No. 401,987, filed Sep. 1, 1989, now abandoned.

BACKGROUND OF THE INVENTION

1. Field of the Invention

The present invention relates to a device for loading and unloading sheet items such as paper containers for milk, etc. to and from main magazines in liquid charging machines.

2. Prior Art

In prior art liquid charging machines, especially liquid food charging machines, main magazines are used to continuously feed sheet items (such as gable top containers) to later processing steps. The main magazines which store the sheet items therein are provided in series so as to allow sheet items to be individually and continuously fed from the magazines.

One type of sheet item, a disposable container for liquid foodstuffs such as milk, juice, etc. which may be used, is a rectangular parallelepiped shape as shown in FIG. 8. In order to facilitate storing, transferring and handling, the container blank A is usually folded flat, as shown in FIG. 7, and then assembled into a rectangular parallelepiped shape which has a square cross section during transfer to later steps. Before filling the container with liquid foodstuff, the parapellepiped blank A' is fed onto mandrel wheels, the bottom is sealed. Then the container is filled with liquid foodstuffs by a liquid charging device.

In order to continuously transfer the flatly folded container blanks A to later steps, the main magazines are installed at the starting point of the later step. The blanks are temporarily held in the main magazine and then individually fed to the later step. When the liquid foodstuff to be filled is different in the quality and/or quantity, the container blanks must be replaced to a proper one. In this case, it is required that the blanks A' remaining in the main magazines be taken out and moved to a different location so that the proper blanks may be placed therein. When they are again to be used, the blanks A' are brought back to the main magazines.

Conventionally, such operation is not carried out automatically. There is no means provided which can take out the remaining blanks from the main magazines, resulting in great inefficiency.

SUMMARY OF THE INVENTION

The present invention solves the problem of the prior art which occur when individual sheet items, such as flatly folded carton blanks, are continuously supplied to later steps from main magazines where they are temporarily stored.

In order to solve the problems of the prior art, the present invention provides a storage magazine so that it is separated from a main magazine which is used to temporarily hold and then supply individual sheet items to later processing. The present invention further provides a grasping means which can hold sheet items and can move between the main magazine and the storage magazine so that the sheet items ar loaded and unloaded in and from these magazines.

It is desirable to install a multiple number of storage magazines, and it is also desirable to position the main magazine at a certain angle. The frame of the robot with the grasping means should also be positioned at the same angle.

The main magazine, which temporarily stores therein the sheet items and continuously supplies them to later processes, is located at a location where the next process stars so that the sheet items are fed to the next process without any interruption. The storage magazine is positioned in a different location from the main magazine.

The robot is movable between the main magazine and storage magazine. It further is equipped with a grasping means and uses the grasping means to hold numerous sheet items or to hold just one sheet item.

When the main magazine is empty, the robot fetches a set of sheet items, brings them to the main magazine and loads them therein. Individual sheet items are then taken out from the main magazine and fed to later processing steps while a desired surface treatment is performed thereon when the sheet items are transferred. When the number of sheet items in the main magazine is decreased, the robot senses this and is moved again. The sheet items are again fetched and loaded in the main magazine.

When the sheet items in the main magazine are needed to be replaced to another type of sheet items, the robot is moved to the main magazine. The grasping means grasps the sheet items remaining in the main magazine and moves them to the storage magazine. The robot then moves to fetch another type sheet items, brings them to the main magazine, and loads the sheet items therein. In this manner the sheet items in the main magazine are changed automatically, without any manual assistance.

In order to reverse the procedure so as to reuse the sheet items previously moved to the storage magazines, it is only necessary, so long as the main magazines are empty, for the robot to fetch the sheet items from the storage magazine and load them back into the main magazine.

When the main magazines contain another type of sheet items, the robot, as described above, is moved to the main magazine and removes such another type of sheet items remaining in the main magazine. Then, the robot is moved to a storage magazine and places therein another type of sheet items. After this, the robot takes out the sheet items which have been stored in an other storage magazine. Then such sheet times are brought to the main magazine by the robot and loaded therein.

In this manner, all of the operations described below can be executed automatically: That is, completely different types of sheet items are supplied to the main magazines; the sheet items that are the same as one in the main magazines can be added therein; the sheet items in the main magazine can be replaced with a new type of sheet items; and the sheet items stored in the storage magazine can be resupplied to the main magazine.

The main magazine and storage magazine can be provided in a multiple number, respectively. If a multiple number of storage magazines are installed, two or more magazines can be used to separately store the same types of sheet item, that is, sheet items which are the same in terms of size, kind of foodstuff to be filled with, etc.

When the main magazine is positioned at an angle, the frame of the robot is positioned at the same angle, so that the robots's grasping means is tilted at the same angle as the main magazine and the sheet items therein.

This is advantageous when sheet items are loaded in the tilted main magazine, when the sheet items are added in the tilted main magazine, and when the sheet items are removed from the tilted main magazines.

BRIEF DESCRIPTION OF THE DRAWINGS

The accompanying drawings illustrate an embodiment of the present invention, in which.

DETAILED DESCRIPTION OF THE INVENTION

A description of the embodiments of the present invention will be made in conjunction with the accompanying drawings.

Figure 8:
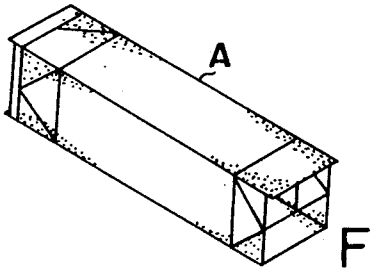
FIG. 8 is a perspective view of a parallelepiped container with a squares cross section in its unfolded form.
Figure 7:
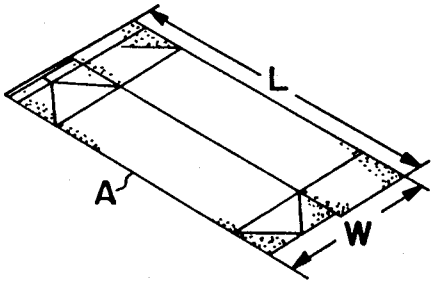
FIG. 7 is a perspective view of an example of a folded sheet item.

The automatic supply and loading device of the present invention is used for sheet items which are flat blanks A before they are formed into parallelepipeds which are square in cross section as shown in FIG. 8. The device of the present invention is used in a series of operations wherein a plurality of blanks are temporarily held or stored in a main magazine, individually taken out of the main magazine and, while being fed to later processes, are formed into parallelepipeds. The blanks shown in FIG. 8 are fed onto mandrel wheels 1 and 2 of a packing machine 3 so that the bottoms thereof are sealed. Then, the blanks are filled with a liquid in the charging section 4.

Figure 1:
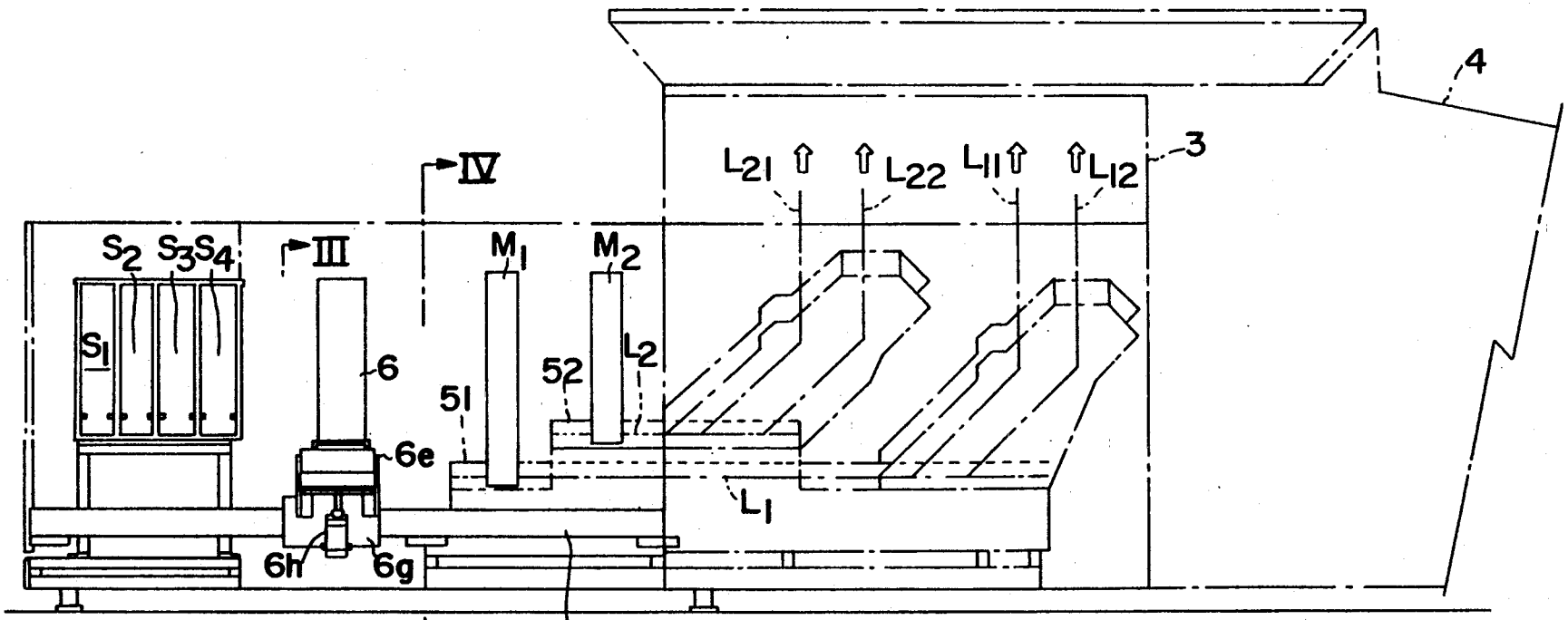
FIG. 1 is a front view thereof.
Figure 2:
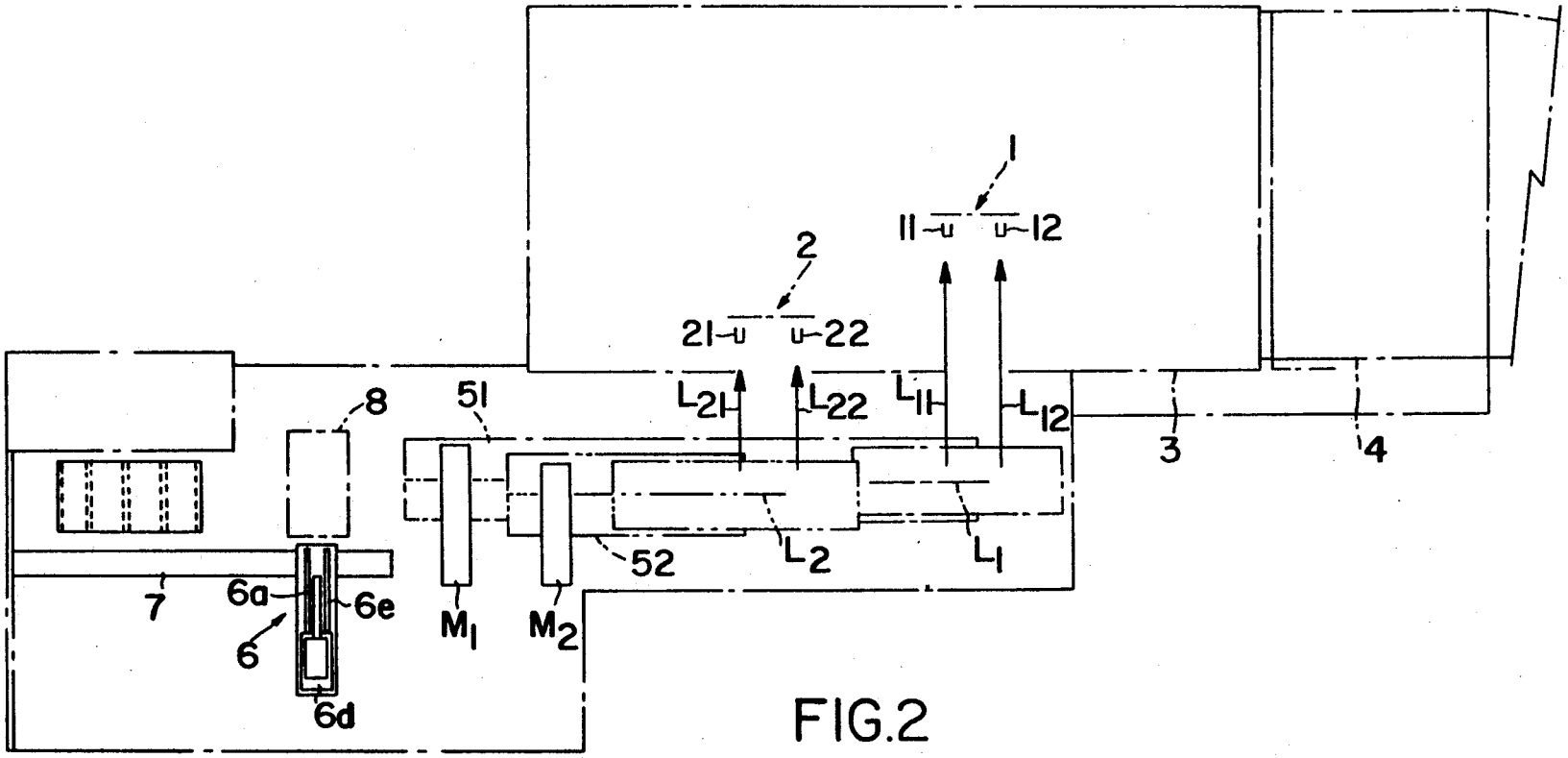
FIG. 2 is a top view thereof.
Figure 6:
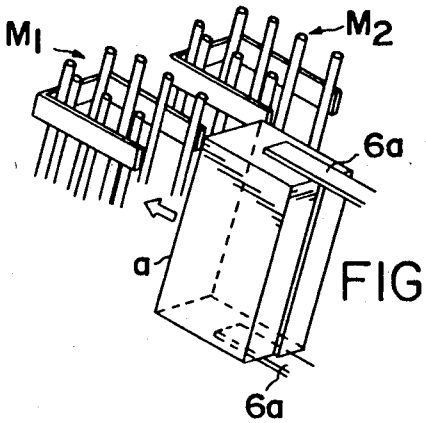
FIG. 6 is a perspective view of a set of sheet items being loaded into a main magazine via the grasping means.

The main magazines $M_1$ and $M_2$, as shown in FIGS. 1 and 2, are positioned in front of the starting point of main conveyors 51 and 52 that are the beginning of a series of conveying lines. A plurality of flatly folded blanks are temporarily held inside the main magazines $M_1$ and $M_2$ and individually taken out, for example, by a suction pad (not shown), and fed to later processes while being formed into parallelepipeds (as shown in FIG. 8) by a device not shown in the drawings. The blanks A' after being formed into parallelepipeds are fed onto the mandrel wheel of the packing machine 3. The main magazines can be formed for example like a shelf as shown in FIG. 6.

More specifically, two main conveyors 51 and 52 are positioned as shown in FIGS. 1 and 2. The flat folded blank is formed into parallelepipeds on two lines L1 and L2 and supplied to the mandrel wheels 1 and 2 in two channels, one to the mandrel wheel 1 indicated by the dotted lines in FIG. 4 and the other to the mandrel wheel 2 indicated by the solid lines. The main magazines are thus positioned at the beginning of each line $L_1$ and $L_2$ as indicated by $M_1$ and $M_2$ in FIGS. 1 and 2.

Line $L_1$ is divided into two channels midway in the main conveyor 51 as indicated by lines $L_{11}$ and $L_{12}$ in FIGS. 1 and 2, and the line $L_2$ is divided into two channels midway in the main conveyor 52 as indicated by lines $L_{21}$ and $L_{22}$ in FIGS. 1 and 2. As shown in FIG. 2, each of the mandrel wheels 1 and 2 is divided into two rows of mandrels 11 and 12 (on the right) and 21 and 22 (on the left) so as to provide a continuous supply of the parallelepiped blanks.

Storage magazines are positioned at a different location from the two main magazines $M_1$ and $M_2$, that is, at the left end in FIGS. 1 and 2. These storage magazines have a simple box shape. Taking into consideration of the capacity, form, and liquids to be filled in the banks, multiple storage magazines $S_1$ through $S_4$ (shown in FIGS. 1 and 2) are appropriate and provided so that the same blanks are stored in one or more storage magazines. With this structure, separate storage for blanks of the same length L in one or more storage magazines $S_1$ through $S_4$ becomes possible when blanks differ in length according to their capacity (assuming that the width W of the blank is the same), allowing different type of blanks to be managed easily.

It is possible to attach casters to the storage magazines $S_1$ through $S_4$ so that they can be moved individually or together. Thus, the blanks can be stored in different locations by, for example, placing the storage magazines S1 through S4 in a store house.

Figure 3:
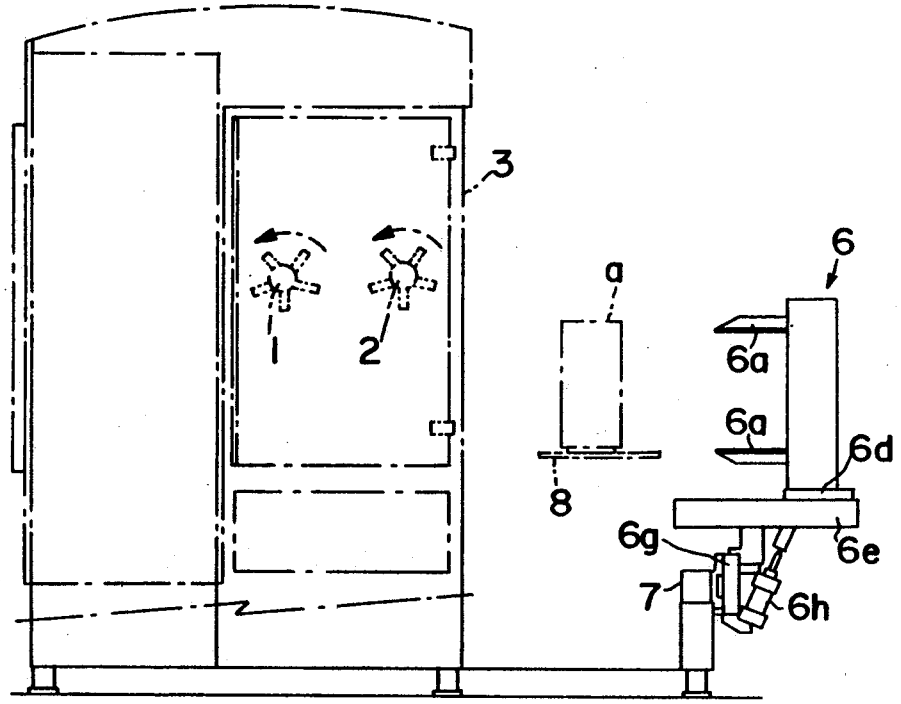
FIG. 3 is a view taken along the line III—III in FIG. 1.
Figure 5:
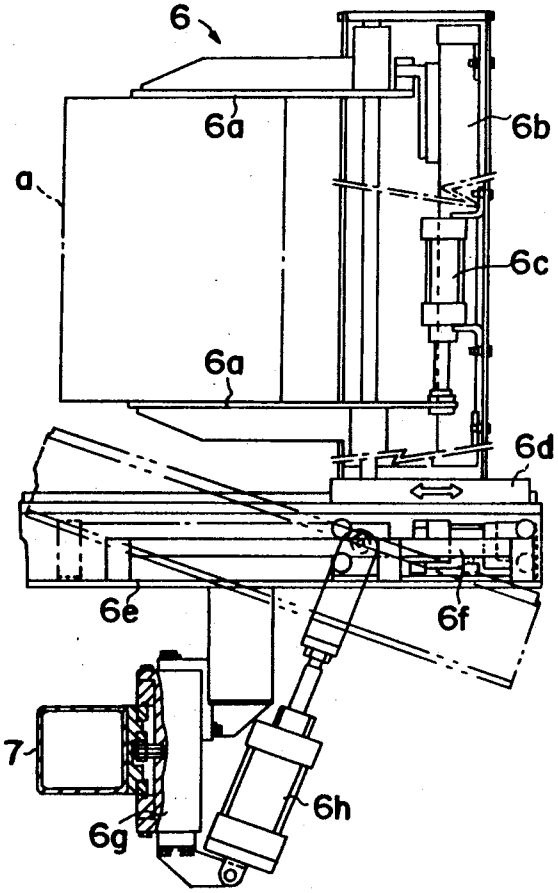
FIG. 5 is an enlarged view of a robot with a grasping means.

A robot 6 moves between the main magazines and the storage magazines. The robot 6, as shown in FIG. 3 and 5, is equipped with a grasping means, e.g. a pair of top and bottom forks 6*a*. The distance between the forks 6*a* can be freely changed by means of two cylinders 6*b* and 6*c* as shown in FIG. 5. The pair of forks 6*a* can hold many blanks, as shown in FIGS. 5 and 6, or just one blank.

In order to move the robot 6 between the main magazines and storage magazines, a guide rail 7 is provided in front of the main magazines $M_1$ and $M_2$ and the storage magazines $S_1$ through $S_4$ as shown in FIGS. 1 and 2. The robot 6 is moved along this guide rail 7 by, for example, a servo motor. However, the invention is not limited to this means, and the robot 6 can, for example, be designed so as to move on a carrier car.

The top and bottom forks 6*a* are provided such that they can come close to and move away from the main magazines $M_1$ and $M_2$ and the storage magazines $S_1$ and $S_4$ so as to load the blanks therein and remove the blanks therefrom. The base 6*d* of the robot 6 runs or slides on the guide rail 6*f* of the frame 6*e* to the left from the position indicated by the solid line in FIG. 5.

Operation of the device of the present invention will be described as follows:

When the main magazines $M_1$ and $M_2$ are empty, as seen in FIG. 3 the robot is moved and a set of blanks (indicated as a) is taken from, for example, the top of a platform 8. In order to grasp the set of blanks a with the pair of forks 6*a*, the robot 6 performs these different operations: 1. moving the base 6*d* toward the platform 8; 2. closing the pair of forks 6*a*; and 3. returning the base 6*d* to its original position after the blanks a are grasped by the forks 6*a*. Then, the robot 6, which has lifted the set of blanks a is moved along the guide rail 7, and the set of blanks a are loaded in the main magazines $M_1$ and $M_2$,. To do this, the robot 6 moves the base 6*d* close to the main magazines $M_1$ and $M_2$, opens the pair of forks 6*a*, and returns the base 6*d* to the original position after the blanks a are loaded in the main magazines $M_1$ and $M_2$.

Once the set of blanks a are loaded in the main magazines $M_1$ and $M_2$, the blanks are individually and consecutively fed from the main magazines to later processes as described above. When the blanks in the main magazines $M_1$ and $M_2$ decrease in number, the robot 6 is moved, and blanks are again removed from the top of the platform 8 and the same process is repeated to refill the main magazines $M_1$ and $M_2$ with blanks.

When either the same or a different liquid is to be filled in a blank having a different capacity, the robot 6 is moved to the main magazines $M_1$ and $M_2$ and the blanks remaining therein are grasped by the forks 6*a*. The robot 6 is then moved to the storage magazines $S_1$ through $S_4$ and blanks are placed in one of them. The robot 6 is then moved again, and new, different blanks are taken from the top of the platform 8 using the same process described before. The robot 6 makes the same movement as before to load these blanks in the main magazines $M_1$ and $M_2$.

When a different type of blank is to be used after using the blanks, the same process is repeated The blanks remaining in the main magazines $M_1$ and $M_2$ are taken out and placed in the storage magazines $S_1$ through $S_4$ other than the one used in the previous process. The robot 6 is then moved again, the blanks on the platform 8 are taken from the top of the platform 8 in the same manner as described before. The robot 6 once again performs the same operation as before to load these blanks in the main magazines $M_1$ and $M_2$.

In order to facilitate storage, transport and handling, the blanks a are wrapped in bundles with a packing material. The packing material covering the blanks must be cut and opened when placing a set of blanks a on the platform 8 (FIGS. 2 and 3). Cutting and opening is automatically performed at an appropriate location by an appropriate device using a conventionally known method, and a set of blanks a without packing materials are placed on the platform 8 in the location shown in FIG. 3. The above operations can be performed on the raised platform 8 when it is raised to a location which is higher than that shown in FIG. 3 after which the platform 8 is lowered to the position shown in FIG. 3.

Reuse of the blanks stored in the storage magazines $S_1$ through $S_4$ is performed as follows: When the main magazines $M_1$ and $M_2$ are empty, it is only necessary for the robot 6 to take them from the storage magazines and load them in the empty main magazines $M_1$ and $M_2$. When there are different types of blanks remaining in the main magazines $M_1$ and $M_2$, the robot 6 makes the above described movement to take out the remaining blanks and place them in an empty storage magazine or in a storage magazine that contains the same type of blanks. Then, the blanks in the different storage magazines are taken by the robot 6 and loaded in the main magazines $M_1$ and $M_2$ in the same manner as described before.

As seen from the above, the following operations are carried out automatically: completely new blanks are loaded in the empty main magazines $M_1$ and $M_2$; blanks which are the same as those in the main magazines are loaded in the main magazines $M_1$ and $M_2$; the blanks remaining in the main magazines $M_1$ and $M_2$ are replaced with a different type of blanks that have been stored in the storage magazines and which are again supplied to the main magazines $M_1$ and $M_2$.

In the embodiment, a plurality of storage magazines $S_1$ through $S_4$ are provided so that different types of blanks can be stored in each of these storage magazines. This not only facilitates management of the blanks but also eliminates the problem of supplying the wrong type of blanks to the main magazines $M_1$ and $M_2$ when reusing a specific type of blanks stored in a particular storage magazines $S_1$ through $S_4$.

When the number of blanks in the main magazines $M_1$ and $M_2$ has decreased and must be replenished, the number of the blanks in the main magazines $M_1$ and $M_2$ is detected via a photocell or sensor (not illustrated). The signal from such device can be transmitted to the robot 6 so that the robot 6 performs the above described loading operations. Information as to what blanks are to be loaded in the main magazines $M_1$ and $M_2$, what blanks stored in the storage magazines $S_1$ through $S_4$ are to be taken out, etc., can all be controlled centrally by a computer, and commands are transmitted to the robot 6 so that all of the above described operations are performed without the presence of the operator.

Figure 4:
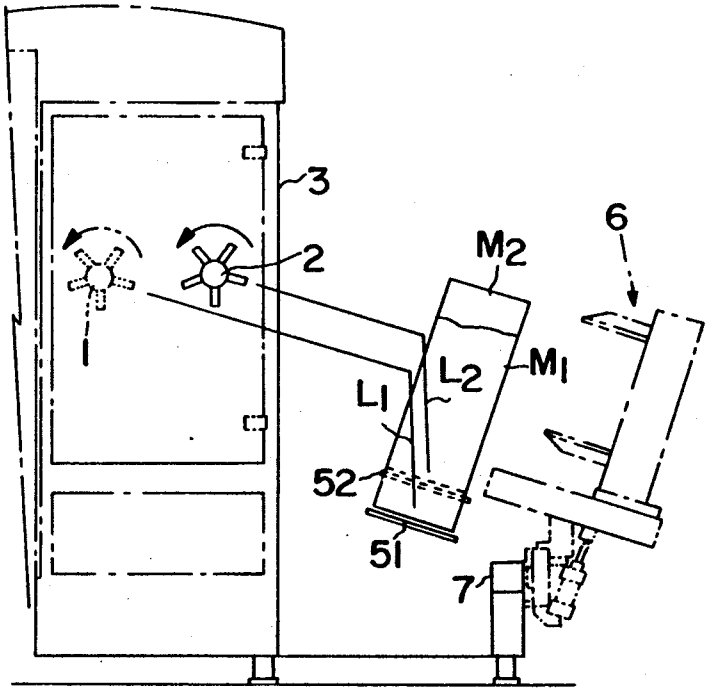
FIG. 4 is a view taken along the line IV—IV in FIG. 1.

The two main conveyors 1 and 2 can both be inclined at an 180 degree angle from a horizontal plane as shown in FIG. 4, and so are the two main magazines $M_1$ and $M_2$ which are located above the conveyers. This angle of inclination is provided so that when the blanks formed into parallelepipeds (before they reach the end of the lines $L_{11}$ and $L_{12}$ or lines $L_{21}$ and $L_{22}$ shown in FIG. 2) are placed on the mandrels 11, 12, 21 and 22 of the mandrel wheels 1 and 2, the angle of the conveyors matches the angle of the mandrels. By adjusting the angles in this way, the parallelepiped blanks can be smoothly placed on the mandrels 11, 12, 21 and 22 at the ends of lines $L_{11}$ and $L_{12}$ or lines $L_{21}$ and $L_{22}$.

The frame 6*e* of the robot 6 is also inclined at exactly the same angle as the main magazines $M_1$ and $M_2$. When a set of blanks a on the platform 8 are removed and the blanks a are loaded in and taken out of the storage magazines $S_1$ through S4, the frame 6*e* is kept horizontal. When these operations are completed, it is preferable to move the frame 6*e* to the location of the main magazines $M_1$ and $M_2$ without changing the angle of inclination as shown by the dotted lines in FIG. 5.

In order to incline the frame 6*e* (as shown by the dotted lines in FIGS. 4 and 5), a cylinder 6*h* is mounted on the main base 6*g* so that the base 6*g* slides along the guide bar 7, and the front end of the rod of the cylinder 6*h* is linked to the frame 6*e*.

When the cylinder 6*h* is operated so that the rod is pulled back from the position shown by the solid lines in FIG. 5, the frame 6*e* can be tilted with respect to the main base 6*g*. If the cylinder 6*h* is operated reversely, the frame 6*e* is returned to a horizontal position. If the frame 6*e* is inclined as shown by the dotted lines in FIG. 5, the forks 6*a* are at exactly the same angle of inclination as the main magazines $M_1$ and $M_2$. In this way, a multiple number of blanks are supplied or replenished to the main magazines $M_1$ and $M_2$ or may be removed therefrom not only smoothly but also without falling apart.

The device according to the present invention can handle a wide range of sheet items other than the flatly folded blanks described above.

According to the present invention, sheet items are automatically supplied to an empty main magazine so as to replenish the main magazine. Sheet items remaining in the main magazine can be replaced with a different type of sheet items, and the sheet items that are stored in a storage magazine can be resupplied to the main magazine. Since the device automatically performs all of the above described operations, rapid shifting to different types of sheet items is possible without the necessity of manual operations.

The same type of sheet items are separately stored in one or more storage magazines so that different types of sheet items are handled easily and so that wrong blanks are not mistakenly supplied to the main magazine when the blanks stored in the storage magazines are reused.

Furthermore, the sheet items are smoothly supplied and replenished to and from the main magazine and the blanks are prevented from falling apart.

I claim:

1. An automatic supplying and loading device for sheet items comprising at least one main magazine for holding therein a stack of said sheet items and for supplying therefrom individual said sheet items one by one to a subsequent process, said main magazine having a longitudinal axis oriented at an angle greater than 0° but less than 90° with respect to a vertical plane, a plurality of storage magazines for temporarily holding stacked sheet items of different sizes respectively and a robot with grasping means to grasp a stack of said sheet items by imparting pressure both to a top and bottom of said stack of said sheet items by means of top and bottom forks long enough to grasp said sheet items of different sizes for supplying a stack of sheet items to said main magazine and for transferring a stack of sheet items reciprocally between said main magazine and said plurality of storage magazines, said robot having a longitudinal axis and being capable of occupying a position in which its longitudinal axis is parallel to the vertical plane and a position in which its longitudinal axis is parallel to the longitudinal axis of the main magazine, said robot grasping and moving said stack of said sheet items to supply sheet items respectively from and to said main magazine and said plurality of storage magazines whereby sheet items of different sizes can be supplied to said main magazine from said plurality of storage magazines.

2. An automatic supply and loading device according to claim 1 wherein said angle is 18°.

* * * * *